United States Patent [19]

Blackwell

[11] 4,355,443

[45] Oct. 26, 1982

[54] BOWL AND SLIPS ASSEMBLY WITH IMPROVED SLIP INSERTS

[75] Inventor: Henry W. Blackwell, Venus, Tex.

[73] Assignee: Dresser Industries, Inc., Dallas, Tex.

[21] Appl. No.: 148,430

[22] Filed: May 9, 1980

[51] Int. Cl.[3] ..... F21B 19/06

[52] U.S. Cl. ..... 24/263 D

[58] Field of Search ..... 24/263 D, 263 DA, 263 DH, 24/263 DT, 263 DQ, 263 CA, 263 DP, 249 DP

[56] References Cited

U.S. PATENT DOCUMENTS

| | | | |
|---|---|---|---|
| 1,375,964 | 4/1921 | Hiniker . | |
| 1,400,701 | 12/1921 | Vreeland | 24/263 DQ |
| 1,435,635 | 11/1922 | Gibbs | 24/263 CA |
| 1,625,540 | 4/1927 | Hertzberg | 24/263 CA |
| 1,693,478 | 11/1928 | Davis . | |
| 1,758,108 | 5/1930 | Goeser | 24/263 DT |
| 1,795,578 | 3/1931 | Smith . | |
| 1,838,439 | 12/1931 | O'Brien | 24/263 DT |
| 1,908,652 | 5/1933 | Adair . | |
| 1,909,602 | 5/1933 | Young . | |
| 1,999,519 | 4/1935 | Standlee | 24/263 CA |
| 2,048,209 | 7/1936 | Young et al. | 24/263 DT |
| 2,061,771 | 11/1936 | McLagan . | |
| 2,065,130 | 12/1936 | Grau et al. . | |
| 2,071,637 | 2/1937 | Laurent . | |
| 2,073,890 | 3/1937 | Tschappat | 24/263 D X |
| 2,143,615 | 1/1939 | Abegg . | |
| 2,290,799 | 7/1942 | Brauer . | |
| 2,410,589 | 11/1946 | Segelhorst . | |
| 2,700,201 | 1/1955 | Bannister | 24/263 DA |
| 2,736,941 | 3/1956 | Mullinix . | |
| 2,890,513 | 6/1959 | Lane . | |
| 3,353,235 | 11/1967 | Adams | 24/263 D |
| 3,365,762 | 1/1968 | Spiri | 24/263 DT |
| 3,454,297 | 7/1969 | Turner, Jr. | 294/90 |
| 3,846,877 | 11/1974 | Spiri | 24/263 |

*Primary Examiner*—Dennis L. Taylor

*Attorney, Agent, or Firm*—J. N. Hazelwood; W. R. Peoples

[57] ABSTRACT

A bowl and slips assembly for supporting tubing in a well includes a plurality of gripping inserts supported on slip bodies by means of a cantilever connection with the inserts hang-supported from the top surfaces of the bodies so the bodies are in compression when supporting tubing in the well. In comparing adjacent slip bodies, one includes a shoulder formed in the top surface thereof so adjacent inserts are supported in vertically spaced positions. A safety ledge integrally formed with each body prevents broken inserts from falling into the well.

11 Claims, 9 Drawing Figures

BOWL AND SLIPS ASSEMBLY WITH IMPROVED SLIP INSERTS

TECHNICAL FIELD

This invention relates generally to a bowl and slips assembly such as may be used in supporting tubing in a well and, more specifically, relates to the construction of the assembly in providing for the use of removable slip inserts.

BACKGROUND ART

In the petroleum industry, a bowl and slips assembly, typically referred to as a spider and slips, comprises a support or bowl having a central opening through which tubing may extend downwardly into an oil well. The sides of the opening are tapered inwardly upon progressing downwardly through the bowl so the opening is generally of an inverted frustoconical shape. To support the tubing upwardly within the bowl, a series of bodies in the form of frustoconical segments are telescoped into the opening. In one form of assembly, there are four such slip bodies dividing the opening into quadrants. Together, the slip bodies define a cylindrical passage through the central opening and the passage is particularly sized to receive the tubing for support by the assembly. Carried on the inside surfaces of the slip bodies for gripping against the outside of the tubing are removable inserts having vertically spaced teeth which typically are configured for one-way gripping to keep tubing from sliding downwardly in the well.

In service use, pairs of the slip bodies may be supported in retracted positions spaced outwardly from opposite sides of the opening to allow tubing to be lowered into the well. When it is desired to move the slip bodies and inserts into the opening to grip the tubing, the bodies are moved into set positions with the teeth gripping against the tubing. Sometimes gripping occurs before downward movement of tubing being lowered into the well is halted and, as a result, high instantaneous forces are generated in the assembly. It will be appreciated that these forces of dynamic loading applied to the inserts and slip bodies can be quite high, particularly when the assembly is used to support the weight of thousands of feet of tubing.

DISCLOSURE OF INVENTION

In general, the present invention contemplates a bowl and slips assembly of the foregoing general character which is easier to use and which has a longer service life than prior similar bowl and slips assemblies. In this respect, the present invention provides connections between the slip bodies and their inserts which are constructed in a particularly unique fashion so that wear and metal fatigue associated with repeated loading in tension during in service use is concentrated in the easily replaceable inserts rather than in other parts of the assembly such as the slip bodies.

Primarily, the present invention resides in the construction of the bowl and slips assembly to include a novel cantilever connection for hanging each of the inserts from their respective slip bodies so the reaction forces through the assembly when supporting the tubing places the slip bodies in compression. Specifically, the inserts are hang-supported from top surfaces of the slip bodies and, between adjacent pairs of slip bodies, these top surfaces are spaced vertically from each other to advantageously position horizontally parallel gripping teeth of identical inserts in vertically offset patterns to avoid creating an unbroken line of force concentration completely around the tubing supported by the assembly.

The invention also resides in the novel manner of mounting the inserts in the slip bodies for easy removal and replacement and in the provision of a safety ledge for keeping the inserts from dropping into the well in the event the cantilever connection should fail.

These and other objects and advantages of the present invention will become more apparent from the following description when taken in conjunction with the accompanying drawings.

BEST MODE OF CARRYING OUT THE INVENTION

Figure 1:
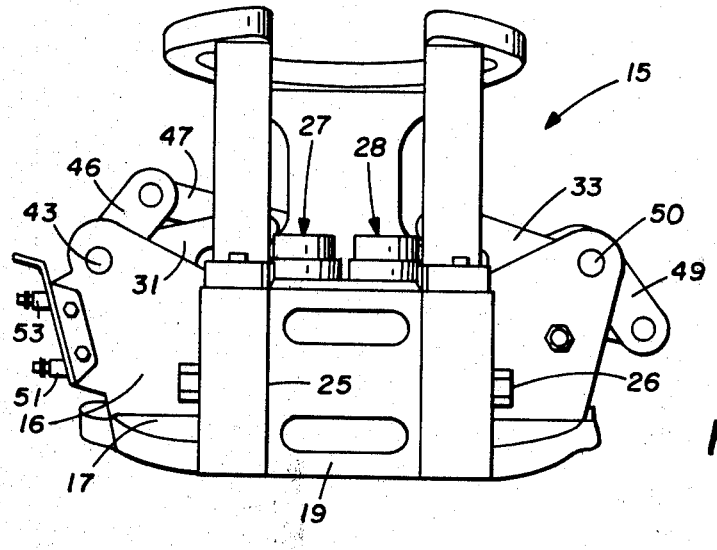
FIG. 1 is a front view of a bowl and slips assembly embodying the novel features of the present invention.
Figure 2:
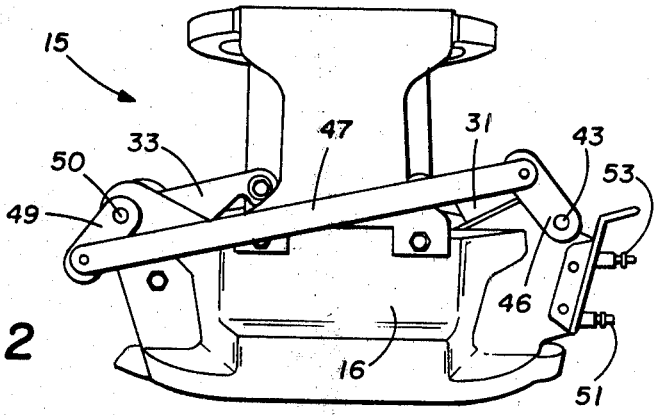
FIG. 2 is a back view of the bowl and slips assembly of FIG. 1.

As shown in the drawings for purposes of illustration, the present invention is embodied in a bowl and slips assembly 15 such as is used in the petroleum industry to support tubing (not shown) in an oil or gas well. Herein, the assembly comprises the support bowl 16 with a bottom flange 17 (see FIGS. 1 and 6) for attaching the bowl at the well head. When removed, a gate 19 in one side of the bowl connects tubing to be loaded sideways into axial alignment with the well bore. In place, the inner surface of the gate is tapered in conformity with the remaining portion of the bowl to define a central opening 20 through which the tubing may be lowered into the well. The gate is held against radial movement relative to a central axis 21 of the opening by interfitting groove 23 and ridge 24 connections formed in opposite ends of the gate (see FIG. 3) and the adjacent sides of a gate opening 25 in the bowl. Additionally, a retaining pin 26 telescoped horizontally through the bowl and the gate serves to support the gate against vertical movement once in place.

The central opening 20 of the bowl 16 is generally of an inverted, frustoconical shape and thus tapers inwardly upon progressing downwardly through the bowl. To support the tubing within the bowl, a series of similarly tapered slip bodies 27*a* and 27*b* and 28*a* and 28*b* fit within the opening and include inner gripping surfaces or teeth 29 particularly adapted to bite against the outside of the tubing within the bowl and support such tubing against downward movement into the well. Herein, teeth 29 are formed on the inside surface of removable inserts 30 carried by the slip bodies and are shaped for one-way gripping to keep the tubing from sliding downwardly in the well. Because of the wedge effect of the slip bodies in the tapered opening, downward movement of the tubing produces an almost instantaneous gripping of the tubing by the teeth 29.

Figure 4:
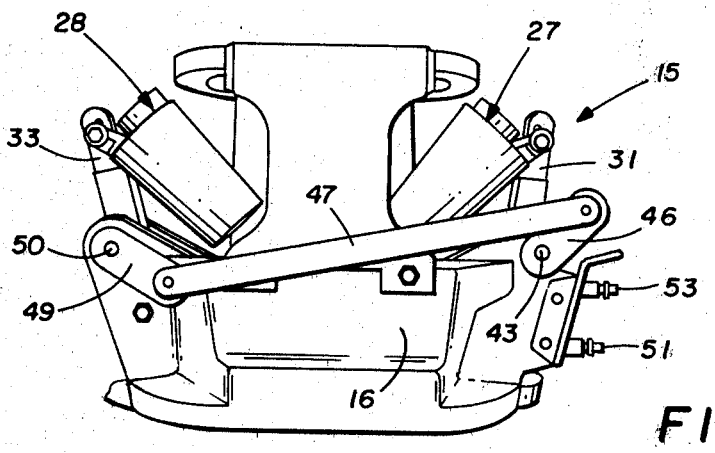
FIG. 4 is a view similar to FIG. 2 but showing parts of the assembly in moved positions.
Figure 3:
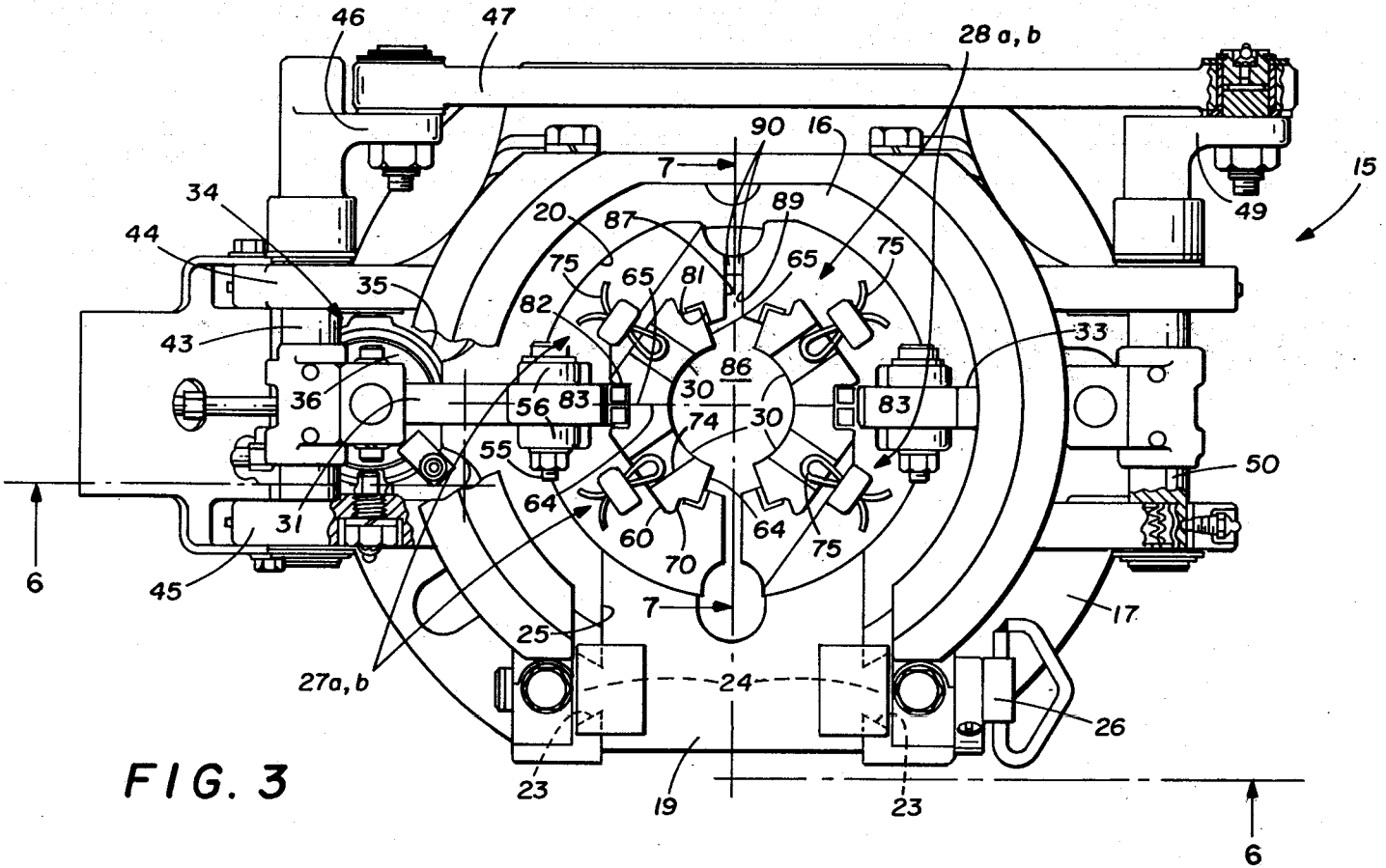
FIG. 3 is a plan view of the assembly shown in FIG. 1.
Figure 6:
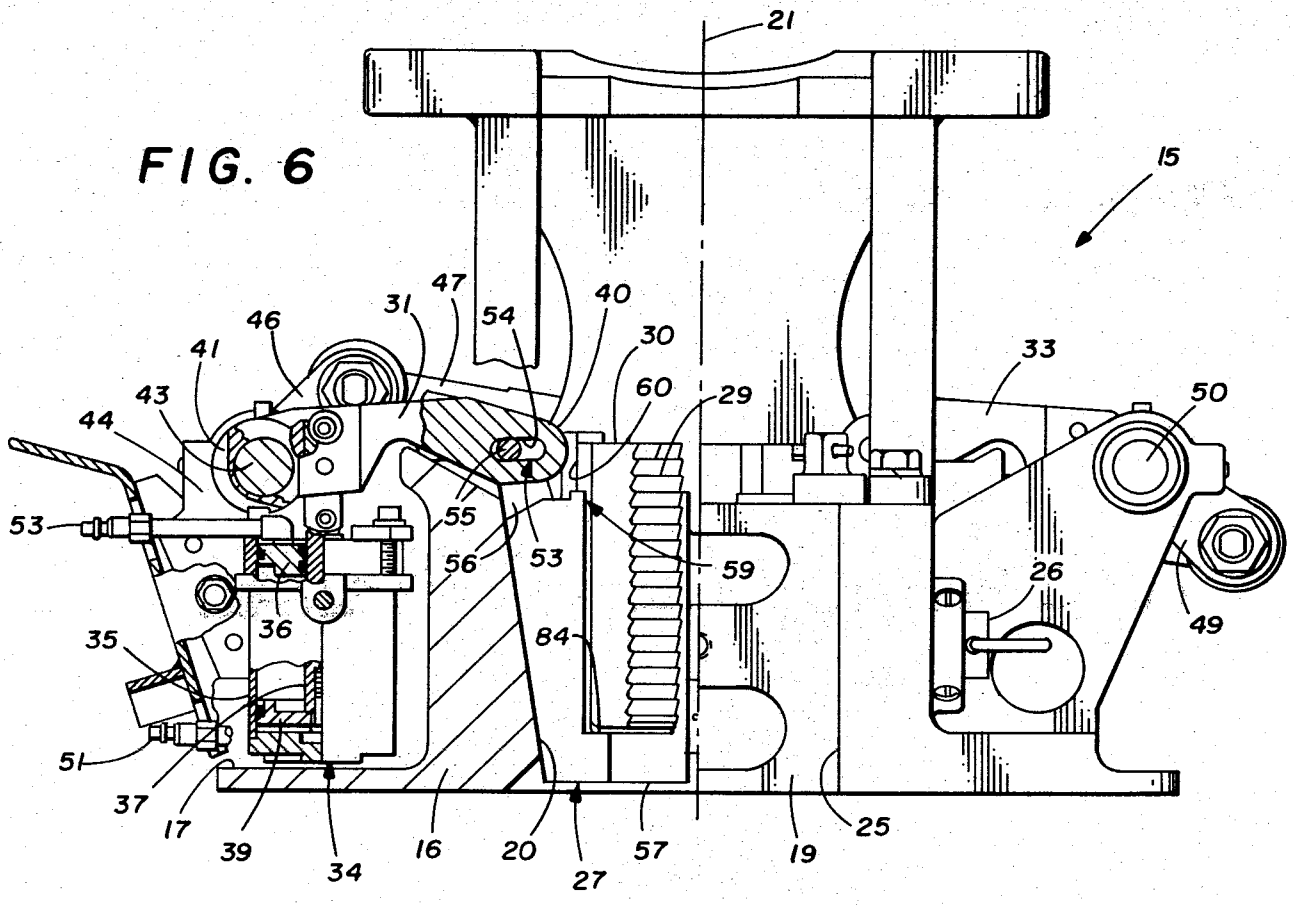
FIG. 6 is a partial, cross-sectional and elevational view taken substantially along line 6—6 of FIG. 3.

More particularly, as shown in FIG. 3, the slip bodies are connected in pairs 27*a*, 27*b* and 28*a*, 28*b* on carrier arms 31 and 33, respectively, which are disposed on opposite sides of the bowl 16 for movement between set positions with the slips disposed within the opening 20 and retracted positions with the slips pivoted upwardly and outwardly of the opening as shown specifically in FIG. 4. Herein, a hydraulic actuating mechanism 34 is utilized to pivot the carrier arms 31 and 33 in lifting the slip bodies from their set positions and into their retracted positions. As shown in FIGS. 3 and 6, such mechanism includes a hydraulic cylinder 35 supported on one side of the bowl 16 with a rod end 36 of the cylinder facing upwardly. A rod 37 connected to a piston 39 (FIG. 6) in the cylinder projects upwardly therefrom to connect pivotally with the carrier arm 31 intermediate inner and outer ends 40 and 41 thereof. The outer end of the carrier arm 31 is fixed to a pivot shaft 43 rotatably supported within journals 44 and 45 (see FIG. 3) connected to the bowl. Adjacent the backside of the bowl, a lever arm 46 is fixed by one end to the shaft 43 and an opposite end of the lever arm is pivotally connected to one end of an elongated link 47 extending along the back side of the bowl. At an opposite end of the link 47, a second lever arm 49 is fixed to a second pivot shaft 50 which is mounted on the bowl to connect with the arm 33 in a fashion similar to that of the shaft 43 and carrier arm 31. With this construction, when hydraulic fluid through a line 51 enters the bottom of the cylinder 35, the piston 39 is forced upwardly exhausting fluid above the cylinder to a line 53 and pivoting the carrier arm 31 and shaft 43 in a counterclockwise direction as viewed in FIG. 6 while at the same time shifting the link 47 to the left thereby pivoting the shaft 50 clockwise and lifting both pairs of slip bodies 27 and 28 from the bowl simultaneously. Movement of the slip bodies from their retracted positions into their set positions is accomplished merely by reversing the application of pressure fluid so as to flow into the cylinder through the line 53 and out through line 51.

Figure 5:
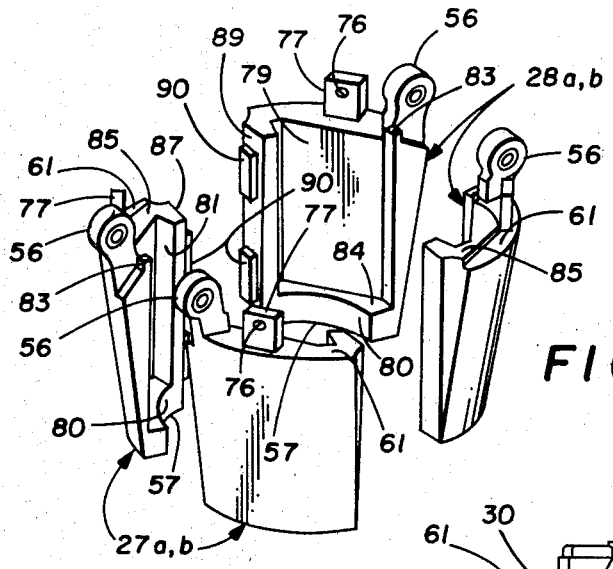
FIG. 5 is a perspective view showing specific parts of the assembly in exploded relationship to each other with other parts of the assembly omitted for clarity.

In moving the pairs of slip bodies 27 and 28 between their set and retracted positions, interference with the tubing disposed in the well is avoided by virtue of a lost motion connection 53 between the carrier arms 31 and 33 and the slip bodies. One such connection 53 is shown in FIG. 6 and includes a slightly elongated slot 54 formed in the inner end 40 of the carrier arm 31 to receive a pin 55 which connects with upright brackets or ears 56 (see also FIGS. 3 and 5) extending from the slip bodies 27*a* and 27*b*. A like construction mounts the slip bodies 28*a* and 28*b* on the carrier arm 33. Advantageously, this construction allows the slip bodies to remain in a more nearly vertical orientation relative to the central axis 21 of the opening 20 (rather than cocking angularly with respect to vertical) as the carrier arms 31 and 33 are pivoted by allowing the pins 55 to traverse horizontally along the slots 54. Thus, interference between bottom inner edges 57 (see FIGS. 5 and 6) of the slip bodies 27 and 28 and the outer surface of the tubing is avoided.

In service use, it is not unusual for the slip bodies 27 and 28 to be moved into their set positions for supporting tubing even though downward movement of the tubing in the well has not been halted completely. Accordingly, it will be appreciated that high instantaneous forces are generated in the assembly 15 resulting both from the dead weight of the tubing and its dynamic loading as the weight impacts on the assembly when the slips bite against and are wedged in the bowl 16. As a result, substantial wear and even breakage of parts of the assembly may occur from repeated impact, loading and relative sliding of the tubing on parts of the assembly.

In accordance with the primary aim of the present invention, the bowl and slips assembly 15 is constructed in a novel fashion for easier in service use and longer useful service life through the provision of a unique connection 59 between each of the slip bodies 27 and 28 and their associated inserts 30. Particularly, these connections are such that wear and metal fatigue associated with repeated loading is concentrated in the inserts and yet allows for easy removal and replacement of the inserts. For these purposes, the connections are cantilevered for hanging the inserts from their respective slip bodies so the reaction of forces through the assembly when supporting tubing places the slip bodies in compression. By virtue of constructing the assembly to utilize cantilever connections in this fashion, the useful service life of each of the slip bodies is increased substantially. Moreover, the cantilever connections are particularly suited for easy replacement of inserts as may be necessary from time to time.

Figure 7:
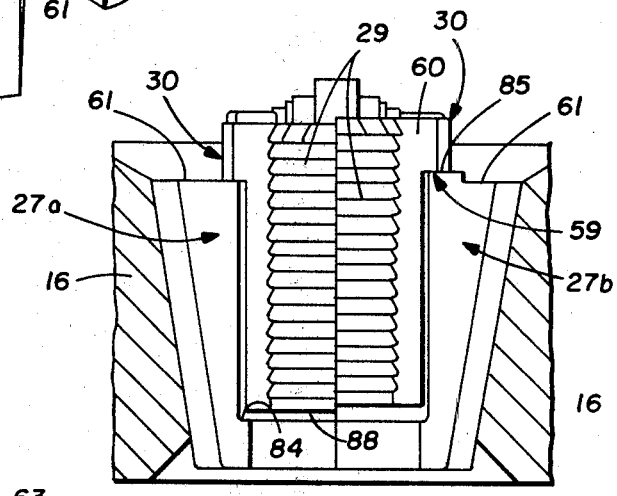
FIG. 7 is an enlarged, fragmentary view taken substantially along line 7—7 of FIG. 3.
Figure 8:
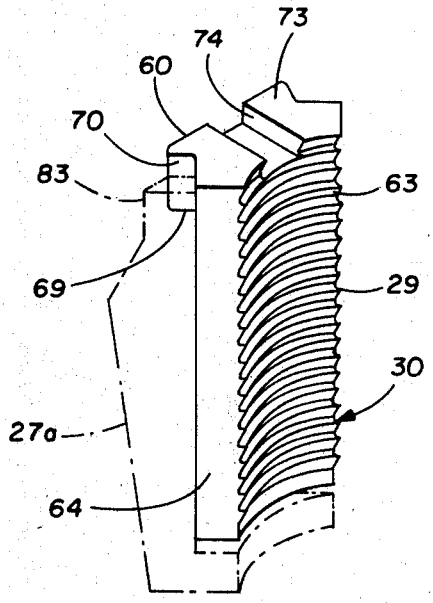
FIGS. 8 and 9 are enlarged perspective views of different sides of a slip body insert utilized in the exemplary bowl and slips assembly.
Figure 9:
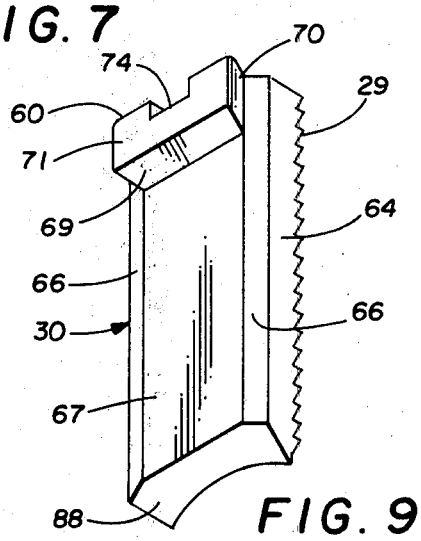

As shown in FIGS. 6 and 7, the connections 59 utilized herein are substantially the same for each of the inserts 30 and their associated slip bodies 27 and 28. Accordingly, only one of the connections will be described in detail, it being understood that such description applies equally to the connections for all of the inserts and their associated slip bodies. In the present invention, the connection 59 is of a cantilever type and includes a lip 60 formed integrally with the insert 30 (see FIGS. 8 and 9) and projecting outwardly therefrom to overlap a top surface 61 of an associated slip body 27*a*. Specifically, the insert is formed substantially as a longitudinal quarter segment of a tubular member and includes an arcuate inner surface 63 upon which the teeth 29 are formed and whose central axis extends colinearly with the central axis 21 of the opening 20 when the insert and its associated slip body are located in their set positions. Opposite sides 64 and 65 (see FIG. 3) of the insert extend in a generally radial direction outwardly from the inner surface 63 to intersect at generally right angles with symmetrical longitudinal flats 66 (see FIG. 9) which define laterally spaced portions of the back side of the insert. Extending between these two flats is a planar outer surface 67. Preferably, the lip is formed integrally with the upper end of the planar outer surface 67 and includes a downwardly facing lower lip surface 69 (see FIGS. 8 and 9) extending outwardly in a generally perpendicular direction from the outer surface 67. Opposite end walls 70 of the lip intersect at substantially right angles with respect to the flats 66 and an outward wall 71 (see FIG. 9) extends in a generally tangential direction relative to the inner surface between the two end walls 70. An upper side 73 of the lip is coplanar with the top surface of the insert and thus is identified by the same reference number. Formed through the upper side of the lip and the top surface of the insert is a generally rectangular groove 74 extending in a generally radial direction relative to the central axis of the insert. The insert 30 is hang-supported on the slip body 27*a* with the lower surface 69 of the lip 60 overlapping and abutting the top surface 61 of the body. Supporting the insert against upward movement on the body is a keeper 75 (see FIG. 3) which in the present instance is in the form of a cotter pin extending from within the groove 74 and through the hole 76 (see FIG. 5) in an upright lug 77 which is integrally formed with the top surface 61.

Additionally, the insert 30 is captivated on the slip body 27*a* by a telescoping interfit within slot means formed within the slip body. Herein, the slot means is of a configuration corresponding to the configuration of the insert so as to define a generally dovetail like interfit limiting the insert against movement both in a generally inward radial direction and in a sideways or circumferential direction relative to the slip body. Specifically, the slot means comprises a recess 79 (see FIG. 5) which is formed within an inner surface 80 of the slip body 27*a* and is defined by an open top, a closed side 81, and an open side. The closed side extends edgewise in a generally radial direction for abutting engagement with the radial side 65 of the insert. To captivate the other side of the insert within the recess, an integral projection 83 (see FIGS. 5 and 8) extends upwardly from the top surface 61 of the slip body adjacent the open side thereof and abuts the end wall 70 of the lip 60 with an upright sidewall 82 (see FIG. 3) to prevent the insert from moving radially inward when the lip is seated against the top surface of the slip body. The projection also serves to limit sideways movement of the insert in a direction circumferentially toward the open side of the recess 79. Additionally, such sideways movement is prevented by an adjacent insert 30 in the adjacent slip body 27*b*. Herein, the latter body 27*b* is a mirrow image of the slip body 27*a* so the open sides of the recesses 79 face each other and thus sides 64 and 65 of adjacent inserts are juxtaposed relative to each other.

As a safety feature for supporting the insert 30 against dropping into the well in the event of breakage during in service use, an added feature of the present invention resides in the provision of a stop 84 for blocking downward movement of the insert in the recess 79. Herein, the stop is in the form of a ledge 84 extending radially inward from the back side of the recess. Preferably, the ledge is spaced below the top surface 61 of the slip body 27*a* a distance greater than the length of the insert extending beneath the lower surface 69 of the lip 60. As a result, when the insert 30 is positioned within the recess of the slip body 27*a*, the lower end 88 (see FIGS. 7 and 9) of the insert is spaced upwardly of the ledge 84.

Of further advantage herein, the inserts 30 are contemplated as being of identical construction with their teeth 29 extending horizontally and parallel to each other. Thus in addition to manufacturing simplicity, for example, in any set of four inserts 30, the positions of the inserts in the slip bodies 27 and 28 are fully interchangeable.

To avoid creating lines of stress concentration around tubing from the teeth 29 of identical inserts 30 biting into the sides of the tubing, the present invention further contemplates vertically offsetting the horizontal pattern of teeth in adjacent inserts to grip the tubing at vertically spaced positions. For this purpose, one of the slip bodies 27*a*, 28*a* in each pair includes an upper shoulder 85 formed in the top surface 61 of the body to a vertical height equal to one-half the distance between two adjacent teeth 29 of the insert. Herein, the shoulder 85 is formed integrally with the top of the slip body and along the inner surface 80 thereof for supportive engagement with the lower surface 69 of the insert 30. Accordingly, when all of the inserts are mounted on their respective slip bodies so the teeth 29 of adjacent inserts define a central passage 86 (see FIG. 3) through which the tubing extends into the well, the teeth are positioned bite in and support the tubing in such a way as to keep from creating a continuous line of stress concentration around the tubing.

To keep the slip bodies 27 and 28 from wedging too tightly together when in their set positions without tubing in the passage 86, facing side ends 87 and 89 of the slip bodies 27*a* and 28*a* opposite the gate 19 (see FIG. 3) include spacers 90. Specifically herein, two of the spacers 90 are formed integrally on the side end wall 87 and are positioned vertically thereon for abutting engagement with two spacers on the side end wall 89 of the adjacent slip body 28*a* when the bodies 27*a* and 28*a* are lowered in the bowl 16. With tubing extending through the bowl, however, the thickness of the spacers on the adjacent bodies 27*a* and 28*a* is such that the spacers are held apart by engagement of the teeth 29 with the tubing.

In view of the foregoing, it will be appreciated that the present invention brings to the art a novel bowl and slips assembly 15 which by virtue of the unique interfitting relationship of the slip bodies 27 and 28 and their associated inserts 30 and the novel manner of hang-supporting the inserts on the slip bodies serves to increase the useful service life of the slip bodies and to allow easy replacement of the inserts either for reasons of wear or to accommodate tubing of different sizes. Advantageously, the cantilevered hanging support of the inserts on the slip bodies 27 and 28 is such as to concentrate wear and metal fatigue in the easily replaceable inserts while subjecting the slip bodies primarily to the less harsh compressive forces of loading as compared to tensile loading forces. Replacement of the inserts may be accomplished by simply and quickly actuating the hydraulic mechanism 34 to retract the slips, removing the cotter pins 75, and sliding the inserts to be removed out of the slip bodies. Thereafter, the replacement inserts may be slid into the open recesses 79 and the cotter pins 75 replaced to complete locking the inserts on the slip bodies. Reverse actuation of the hydraulic mechanism 34 then positions the slip bodies and inserts in the bowl 16 for gripping and supporting tubing vertically within the well.

The embodiments of the invention in which an exclusive property or privilege is claimed are defined as follows:

1. In a bowl and slips assembly having a plurality of tapered slip bodies with associated gripping inserts angularly spaced about the central axis of and mounted on a support bowl for movement between retracted and set positions with respect to a tapered opening in the bowl for the inserts to grip against the outside surface of tubing to support the latter upwardly in a well, the improvement in said assembly comprising a cantilever connection hang supporting each of said inserts from their respective slip bodies in a load bearing position so the reaction of forces through the assembly when supporting tubing places said slip bodies in compression, each of said connections including a top surface on said slip bodies and each of said inserts including an inner gripping surface and a lip projecting outwardly therefrom with said lips being in overlapping abutting engagement with said top surfaces of said slip bodies in said load bearing position, and with said inserts being substantially identical to each other and said inner gripping surfaces thereof being comprised of a plurality of vertically spaced, substantially parallel teeth, and said top surface of one slip body being offset vertically from said top surface of an adjacent slip body.

2. In a bowl and slips assembly having a plurality of tapered slip bodies with associated gripping inserts angularly spaced about the central axis of and mounted on a support bowl for movement between retracted and set positions with respect to a tapered opening in the bowl for the inserts to grip against the outside surface of tubing to support the latter upwardly in a well, the improvement in said assembly comprising a cantilever connection hang supporting each of said inserts from their respective slip bodies in a load bearing position so the reaction of forces through the assembly when supporting tubing places said slip bodies in compression, each of said connections including a top surface on said slip bodies and each of said inserts including an inner gripping surface and a lip projecting outwardly therefrom with said lips being in overlapping abutting engagement with said top surfaces of said slip bodies in said load bearing position, and each of said bodies including an inner surface curved about a central axis thereof and dovetail slot means formed in said inner surface for receiving and captivating said inserts therein against separation from said body in at least an initial radial direction relative to said central axis, said dovetail slot means including a projection protruding from the top surface of each of said bodies, each said projection having an upright sidewall extending in a generally axial direction relative to said central axis, said lips on each insert having an end wall juxtaposed relative to one of said upright sidewalls to block said insert from being moved out of said slot in a generally radial direction relative to said central axis.

3. A bowl and slips assembly as defined in claim 2 with said dovetail slot means having an open top, an open side, and closed side in adjacent pairs of said insert bodies, said open sides facing each other.

4. A bowl and slips assembly as defined by claim 8 including a spacer positioned between two adjacent slip bodies of different pairs of slip bodies to keep said bodies from sliding downwardly within said tapered opening of said bowl beyond said set position when tubing is not in said bowl.

5. A bowl and slips assembly as defined in claim 2 including a safety stop on each one of said slip bodies and normally spaced directly beneath the associated insert of said body to keep said insert from dropping out of said slip body in the event said connection should fail.

6. A bowl and slips assembly as defined in claim 5 wherein said safety stop comprises a ledge integrally formed with said body and projecting radially inward therefrom to define a closed bottom of said dovetail slot means.

7. A bowl and slips assembly for supporting tubing upwardly within a well comprising, a support bowl with a downwardly tapered opening therethrough for the tubing to extend into the well, a first pair of slip bodies pivotally mounted on said bowl adjacent one side of said opening for movement between a retracted position spaced clear of said opening and a set position within said opening, a second similar pair of slip bodies pivotally mounted on said support on the opposite side of said opening for similar movement between retracted and set positions relative to said opening, fluid pressure actuating mechanism mounted on said support and connected between said first and second pairs of slip bodies for moving said pairs of slip bodies simultaneously between their retracted and set positions, each of said slip bodies having an insert connected thereto and carried thereby for gripping against the outside surface of the tubing to support the latter upwardly in the well, and a cantilever connection between said inserts and their associated slip bodies, said connections supportively hanging each of said inserts in a load bearing position from their respective slip bodies so the weight of the tubing supported by the assembly places said slip bodies in compression.

8. A bowl and slips assembly for supporting tubing upwardly within a well comprising a support bowl with a downwardly tapered opening therethrough for the tubing to extend into the well, a first pair of slip bodies pivotally mounted on said bowl adjacent one side of said opening for movement between a retracted position spaced clear of said opening and a set position within said opening, a second similar pair of slip bodies pivotally mounted on said bowl on the opposite side of said opening for similar movement between retracted and set positions relative to said opening, fluid pressure actuating mechanism mounted on said bowl and connected between said first and second pairs of slip bodies for moving said pairs of slip bodies simultaneously between their retracted and set positions, each of said slip bodies having:

a top surface, a tapering outer surface, a generally concave inner surface curved about a central axis thereof, and a gripping insert carried within a recess in said inner surface, said bodies conforming to the taper of said opening when in their set positions with their inserts gripping the outside surface of the tubing to support the weight of the latter upwardly within the well, and each of said gripping inserts having a lip protruding outwardly thereof in a generally radial direction relative to said central axis and overlapping said top surface of said slip body associated therewith for said body to support said insert in hanging cantilever fashion in a load bearing position so the weight of the tubing carried by the assembly places each of said slip bodies in compression.

9. A bowl and slips assembly as defined in claim 8 wherein said gripping inserts each include inner gripping surfaces defined by substantially parallel teeth spaced vertically from each other in an identical pattern from one insert to the next, said pattern of said teeth in adjacent inserts being offset vertically from each other.

10. A bowl and slips assembly as defined in claim 8 or 9 with said recess for each body being defined by a slot having a closed side, an upright sidewall on each said body opposite said closed side and cooperating therewith to block said insert from being moved out of said slot in a generally radial direction relative to said central axis, a keeper on each said body and connected removably with said insert for blocking the latter against movement upwardly out of said slot, and a safety stop on each said slip body positioned beneath said insert to block said insert against movement out of said recess.

11. A bowl and slips assembly as defined in claim 10 including a lost motion connection between said hydraulic actuating mechanism and each of said pairs of slip bodies.

* * * * *

UNITED STATES PATENT AND TRADEMARK OFFICE

CERTIFICATE OF CORRECTION

PATENT NO. : 4,355,443

DATED : October 26, 1982

INVENTOR(S) : Henry Wayne Blackwell

It is certified that error appears in the above—identified patent and that said Letters Patent is hereby corrected as shown below:

Claim 4, line 43, "8" should read "3"

Signed and Sealed this

*Twenty-fifth* Day of *January 1983*

[SEAL]

*Attest:*

GERALD J. MOSSINGHOFF

*Attesting Officer*

*Commissioner of Patents and Trademarks*